United States Patent [19]

Strauss

[11] Patent Number: 4,559,135

[45] Date of Patent: Dec. 17, 1985

[54] SHORT, BROAD JIGGING MACHINE, PARTICULARLY FOR FINEST GRAIN SIZING OF MINERALS

[75] Inventor: Werner Strauss, Bochum, Fed. Rep. of Germany

[73] Assignee: Klöckner-Humboldt-Deutz AG, Fed. Rep. of Germany

[21] Appl. No.: 614,570

[22] Filed: May 29, 1984

[30] Foreign Application Priority Data

Jun. 1, 1983 [DE] Fed. Rep. of Germany ..... 3319804

[51] Int. Cl.[4] ..... B03B 5/20

[52] U.S. Cl. ..... 209/455; 209/502; 209/499; 209/495

[58] Field of Search ..... 209/455, 456, 457, 500, 209/502, 425, 426, 427

[56] References Cited

U.S. PATENT DOCUMENTS

| | | | |
|---|---|---|---|
| 1,634,898 | 7/1927 | Delamater | 209/457 X |
| 2,743,816 | 5/1956 | Medley | 209/455 |
| 2,925,179 | 2/1960 | Hood | 209/455 |
| 3,285,414 | 11/1966 | Bosman | 209/457 |
| 3,890,223 | 6/1975 | Stern | 209/457 |
| 4,303,510 | 12/1981 | Horn | 209/500 X |

FOREIGN PATENT DOCUMENTS

| | | | |
|---|---|---|---|
| 2527756 | 1/1977 | Fed. Rep. of Germany | 209/457 |
| 0320303 | 1/1972 | U.S.S.R. | 209/457 |

OTHER PUBLICATIONS

German Utility Model Abstract 81 19 765, 07/07/81, (Brief Abstract with figure 1).

*Primary Examiner*—Frank W. Lutter
*Assistant Examiner*—Thomas M. Lithgow
*Attorney, Agent, or Firm*—Hill, Van Santen, Steadman & Simpson

[57] ABSTRACT

A jigging machine comprises at least one pulsation chamber, particularly for finest grain sizing of coal or other minerals which traverse the jigging machine on the jig bed which is shorter in the direction of motion of the minerals that at right angles to the direction of motion, whereby the jigging machine is designed as a bottom-pulsed machine. The jigging machine comprises curved lateral walls whose curvature is such that only tensile stresses occur in the walls, is designed suspended in an upper frame, and has the pulsation chamber disposed immediately below the jig bed which rests on cross tie rods.

2 Claims, 3 Drawing Figures

SHORT, BROAD JIGGING MACHINE, PARTICULARLY FOR FINEST GRAIN SIZING OF MINERALS

BACKGROUND OF THE INVENTION

1. Field of the Invention

The present invention relates to a jigging machine comprising at least one pulse chamber, particularly for finest grain sizing of coal or other minerals which traverse the jigging machine on a jig bed which is shorter in the direction of motion of the minerals than it is perpendicular to the direction of motion.

2. Description of the Prior Art

A jigging machine for sizing minerals which is generally designed in accordance with the above statement is known from the German Utility Model No. 81 19 765. This jigging machine, however, has the disadvantage that the jigging stroke is of irregular size in the throughput direction of the minerals.

SUMMARY OF THE INVENTION

An object of the invention is to provide a jigging machine wherein the flow through of the jig bed and the jigging stroke for the minerals to be separated is the same everywhere in the throughput direction of the minerals so that, in particular, mineral fractions that are difficult to separate can be processed well.

The above object is achieved, according to the present invention, in that the jigging machine is designed as a bottom-pulsed machine. A jigging machine of the type previously disclosed in the aforementioned German Utility Model No. 81 19 765 is easiest to execute as a side-pulse machine. Thorough test have shown, however, that a uniform jigging stroke is particularly beneficial for the separation of minerals that are difficult to process, such as the finest grain coal, diamond ore, chrome ore, etc. Previous theories that the jigging stroke motion can be variable proceeding from the admission to the discharge without deteriorating the quality of the separation have not been confirmed. For the first time, a machine constructed in accordance with the present invention provides the opportunity of specifying a broad, short processing facility which is matched to the optimum conditions and which can optimally process all occurring minerals.

According to a particular feature of the invention, the jigging machine comprises curved lateral walls whose curvature is such that only tensile stresses occur in the walls. A particularly favorable construction of the jigging machine therefore derives in which the wall thickness can be executed thinner and the bearing of the walls can be executed significantly lighter than heretofore known, whereby it is provided that the jigging machine is designed suspended in an upper frame.

The bulging tendency, given standing machines, is thereby also successfully opposed, so that external reinforcing ribs can also be eliminated in an advantageous manner.

It is provided, according to further feature of the invention, that the upper frame comprises cross tie rods. The flexural forces that act on the center portions of the frame are thereby advantageously reduced so that the upper frame can be constructed even lighter. Overall, an embodiment occurs which is executed to save material and costs in a heretofore unattained fashion.

It is provided, according to a further feature of the invention, that the pulsation chamber is disposed immediately below the jig bed. The overall size of the jigging machine is also further diminished as a result thereof, whereby the advantageous effect of an additional support of the jig bed by the pulsation chamber also occurs. An unobtained, favorable support of the jig bed therefore advantageously occurs in the interaction of the cross tie bars and the stabilizing effect of the pulsation chamber.

According to a further feature of the invention, the jigging machine is constructed modularly. It is therefore possible to employ cost-favorable, prefabricated modules (for example, having a size of 1 m) and even enlarge the jigging machine as required, for example by attaching further modules. To this end, the lateral bearing need merely be lengthened and further modules hooked on and a jigging machine enlarged in accordance with the increased processing quantity derives.

It is provided according to a further feature of the invention that the jigging machine comprises a hydraulic discharge apparatus for the heavier minerals. A particularly favorable, simple discharge for the separated, heavy product constituents therefore occurs wherein cost-intensive bucket elevators, etc, can be eliminated.

According to a further feature of the invention, the lower portion of the machine comprises reinforcements which preferably form individual discharge chambers for the separated, heavier minerals. A favorable distribution of the individual heavy product discharges therefore derives which allows a smaller overall size of the overall jigging machine and, in addition, leads to a reinforcement of the lower portion of the jigging machine.

According to a further feature of the invention, the jigging machine comprises a valve control at its lateral walls which is preferably designed as a clack valve control. A particularly favorable possibility for supplying the pulsed air to the pulsation chamber through the lateral walls thereby derives, which leads to a further simplification and cost-effective execution of the jigging machine. A clack valve is thereby particularly advantageous because the same can be designed self-balancing and enables very short opening and closing times which are difficult to obtain with rotary valves. A good filling of the pulsation chamber therefore occurs, even given high jigging stroke frequencies.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
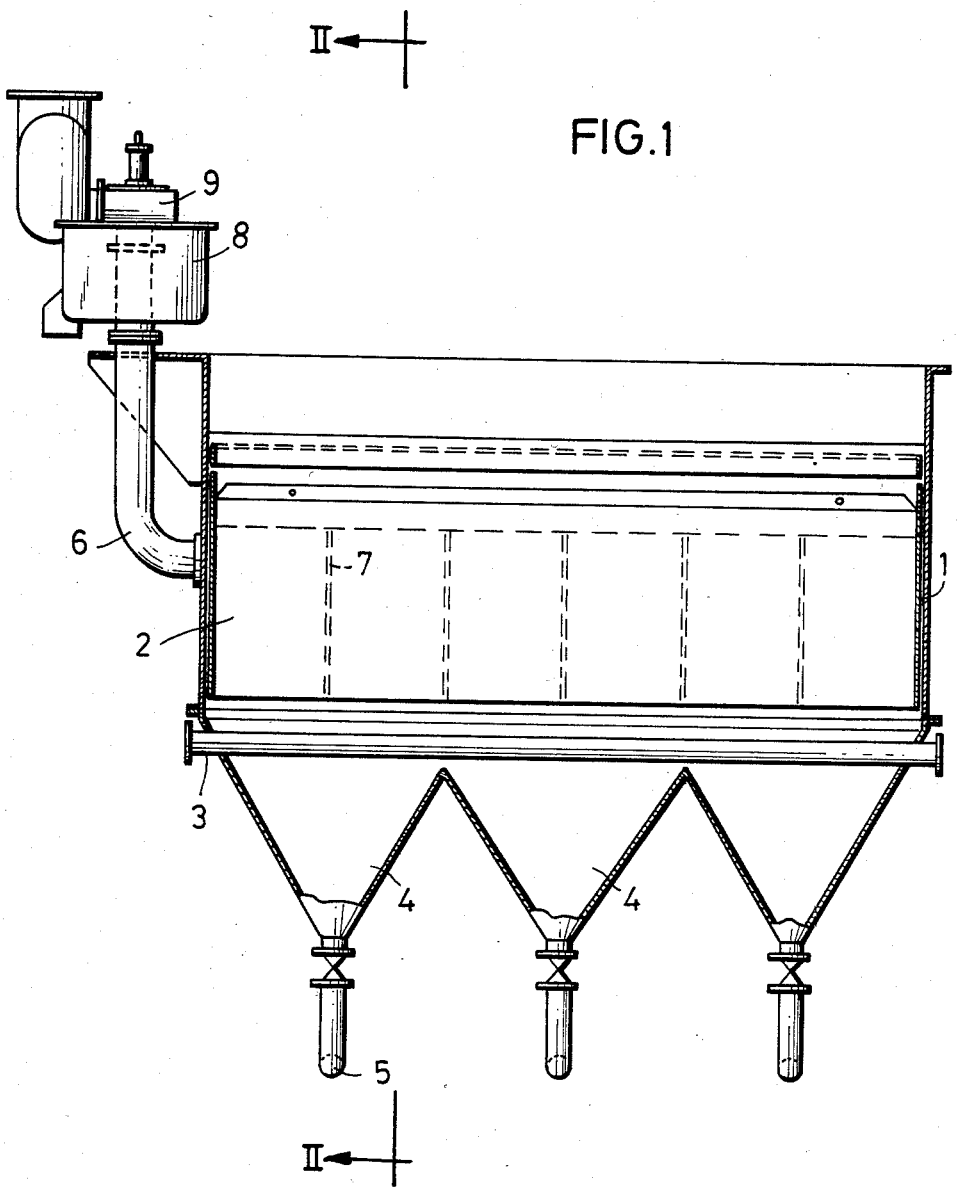
FIG. 1 is a elevation, shown partially in section, of a jigging machine comprising straight lateral and pulsation chamber walls.

In FIG. 1, the machine is illustrated as comprising an end wall 1 and a lateral wall 2. Insert plates 7, spaced in the manner of a comb, carry the internally-disposed pulsation chamber and are located in the jigging machine chamber formed by the walls 1 and 2, which, of course, have counterparts at opposite sides. The lower portion of the jigging machine is formed by the discharge chambers 4 which, as a heavy product discharge, comprise hydraulic discharge conduits 5 that can be closed by way of valves. An air feed 6 is located at one end wall, the air feed leading from an air dome 8 through valves 9 to the pulsation chamber in the interior of the jigging machine.

Figure 2:
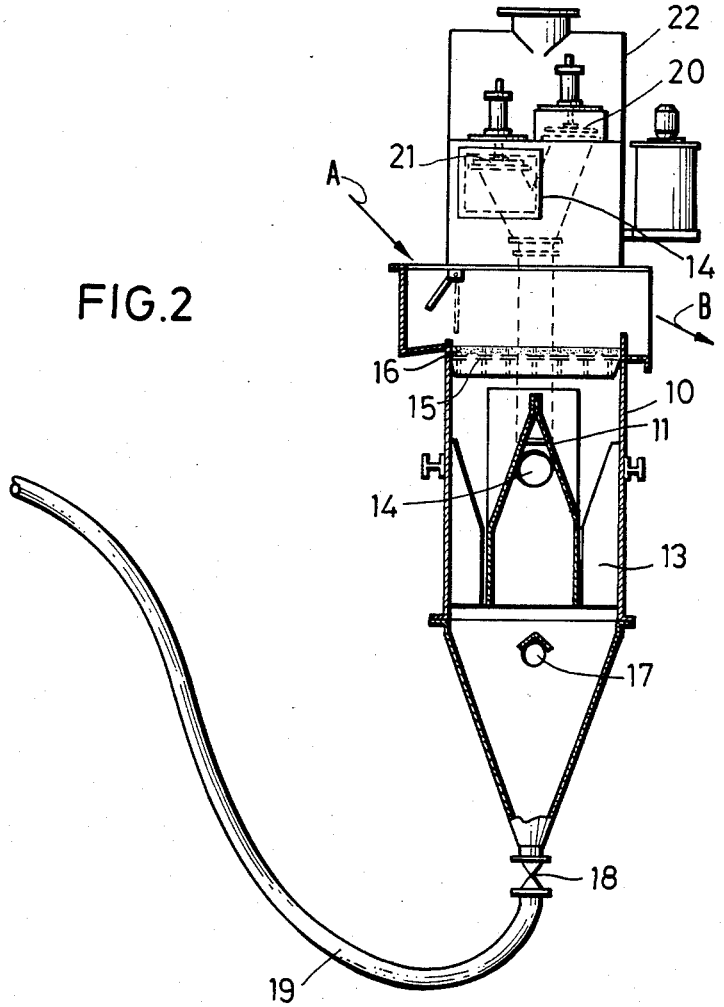
FIG. 2 is a sectional view taken along the parting line II—II of FIG. 1.

In FIG. 2, a straight lateral wall 10 of the jigging machine is supported by way of frame-like carriers (not referenced in detail) which can also advantageously coassume the bearing of the machine. The pulsation chamber 11, having a pulsed air feed 14 in its end face is located within the jigging machine, and is suspended by the plates 13. The jig bed 15 is located in the upper portion of the jigging machine, the jig bed being seated on a supporting frame, and the mineral mix 16 to be separated is illustrated as being supported by the jig bed 15. An underwater feed pipe 17 having a hood-like cover is located in the lower portion of the jigging machine. The discharge of the heavier minerals that have been separated occurs through the hydraulic conduits 19 which communicate with the discharge chambers in the lower portion of the jigging machine via the valves 18 which are preferably designed as slide valves.

In the front view of FIG. 2, the valve control unit comprising the outgoing air dome 22 and the valves 20 and 21 is located behind the jigging machine. The valves 20 and 21 are designed as disc valves. The feed of the materials to be separated in the discharge of floats are individually indicated by respective arrows A and B.

Figure 3:
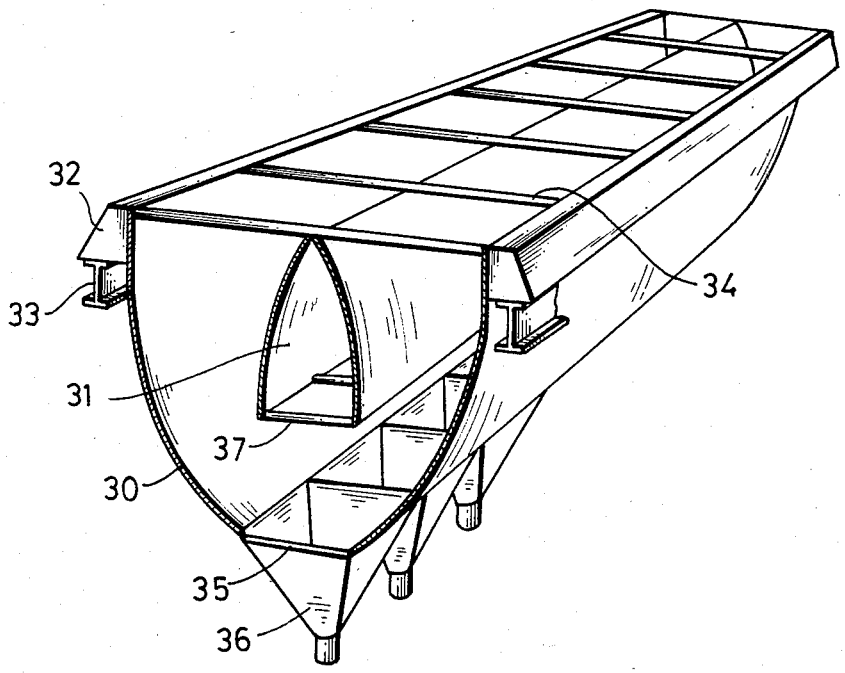
FIG. 3 is a perspective illustration of a jigging machine, shown also in section, and comprising curved lateral and pulsation chamber walls.

In FIG. 3 curved lateral walls 30 of a jigging machine are illustrated as forming a chamber within which a pulsation chamber 31 is provided, the pulsation chamber 31 also having curved walls. The jigging machine is seated via the lateral walls 32 on carriers 33 which, together with cross tie bars 34 permit a light and resistance seating and bracing. The jig bed (not shown in detail) preferably a perforate plate, is also additionally placed on the tie rods 34. In a manner similar to that of the upper side of the jigging machine, the underside of the pulsation chamber 31 also comprises cross tie rods 37 like the cross tie rods 34. The bottom termination of the jigging machine is formed by discharge compartments 36 having cross ribs 35 which further reinforce and stiffen the lower portion of the jigging machine. Overall, the tie rod or, respectively, cross rib structure in combination with the lateral walls 30, which are only subject to tensile stresses, produces a construction that can be manufactured at lower costs and designed significantly lighter in comparison to previously known executions.

The jigging machine of the present invention has been particularly developed for processing coal; however, as has been shown, it can also be successfully employed for processing diamond ore, chrome ore, etc. Shared by all cases of use is that the jigging machine of the present invention makes it possible to carry out a finest grain sizing in a heretofore unattainable and cost-effective manner, given a very good separating effect at the same time.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A bottom-pulsed jigging machine comprising:

a separating tank including a pair of end walls and a pair of sidewalls, said sidewalls curved inwardly from the top down towards one another;

a plurality of first tie bars spaced apart and connecting the upper edges of said sidewalls;

a jig bed supported on the upper edges of said sidewalls and on said first tie bars;

a pair of internal walls below and supported by said first tie bars and extending the length of said separating tank, said internal walls connected along their upper edges and curved away from one another from the top down to define an open bottom pulsation chamber adapted to support pulsating air for jigging;

means connected in communication with said open bottom pulsation chamber and operable to provide air pulsations thereto;

a plurality of second tie bars spaced apart and connecting the lower edges of said internal walls;

a pair of first support members extending along and connected to the upper edges of respective sidewalls; and a pair of second support members supporting said tank via respective first support members.

2. The bottom-pulsed jigging machine of claim 1, and further comprising:

means defining at least one discharge chamber connected to the bottom edges of said sidewalls, said means comprising transverse plates connecting said sidewalls.

* * * * *